US006943313B2

(12) United States Patent
Evans et al.

(10) Patent No.: US 6,943,313 B2
(45) Date of Patent: Sep. 13, 2005

(54) ROTATING ARC FAULT-CURRENT INTERRUPTER

(75) Inventors: Daniel J. Evans, Chicago, IL (US); Michael R. Smith, Griffith, IN (US); Roy T. Swanson, LaGrange Park, IL (US); Martin Zeitler, Jr., Mt. Prospect, IL (US)

(73) Assignee: S & C Electric Co., Chicago, IL (US)

( * ) Notice: Subject to any disclaimer, the term of this patent is extended or adjusted under 35 U.S.C. 154(b) by 0 days.

(21) Appl. No.: 10/268,457

(22) Filed: Oct. 9, 2002

(65) Prior Publication Data

US 2004/0069749 A1 Apr. 15, 2004

Related U.S. Application Data

(60) Provisional application No. 60/350,518, filed on Oct. 22, 2001.

(51) Int. Cl.[7] ..... H01H 9/44
(52) U.S. Cl. ..... 218/29; 218/23; 218/154
(58) Field of Search ..... 218/23, 26, 29, 218/37, 38, 40–42, 16–22, 146, 148, 153, 154

(56) References Cited

U.S. PATENT DOCUMENTS 4,079,219 A * 3/1978 Weston ..... 218/29
4,409,446 A * 10/1983 Parry ..... 218/26
4,918,268 A * 4/1990 Pothieux et al. ..... 218/26
4,980,527 A * 12/1990 Eppinger ..... 218/29
5,003,138 A * 3/1991 Bolongeat-Mobleu et al. ... 218/26
5,149,928 A * 9/1992 Kamp ..... 218/29
5,464,956 A * 11/1995 Steele et al. ..... 218/29

* cited by examiner

*Primary Examiner*—Karl D. Easthom
*Assistant Examiner*—M. Fishman
(74) *Attorney, Agent, or Firm*—James V. Lapacek

(57) ABSTRACT

A rotating arc fault-current interrupter, also known as an arc spinner interrupter, is provided that establishes an easily visible open gap via a movable blade member having a first portion for engaging a stationary main contact and a second portion formed by an arcing electrode for engaging an auxiliary contact associated with an arc spinner assembly. The geometry, orientation and placement of the auxiliary contact is such that during opening of the movable blade member, the arcing electrode remains engaged with the auxiliary contact after the blade member and the stationary main contact are separated from each other whereby current is transferred through the auxiliary contact into the arc spinner assembly, i.e. the current is commutated into the arc spinner assembly. Thus, the current in the arc spinner creates a magnetic field to cause the arcing current to rotate rapidly so as to extinguish the arc as the arcing electrode separates from the auxiliary contact and moves to the opened position whereby a visible open gap is established that is easily visible without any obstructions from a range of viewing angles or orientations.

7 Claims, 4 Drawing Sheets

ROTATING ARC FAULT-CURRENT INTERRUPTER

This application claims the benefit of U.S. Provisional Application No. 60/350,518 filed on Oct. 22, 2001.

BACKGROUND OF THE INVENTION

The present invention relates generally to current-interrupting devices for electrical power distribution systems and more particularly to a rotating arc fault-current interrupter that establishes an easily visible open gap.

Various interrupting devices including rotating arc interrupters have been proposed that utilize magnetic fields to perform their functions. For example, see the following U.S. Pat. Nos. 4,409,446; 4,529,853; 5,003,138 and 5,464,956.

While the prior art arrangements may be useful to provide current interrupting devices for general purposes and for use in circuit breakers, these arrangements are relatively large and cumbersome and do not lend themselves for use in distribution switchgear where small size and the visibility of an open switch gap is desirable.

SUMMARY OF THE INVENTION

Accordingly, it is a principal object of the present invention to provide a rotating arc fault-current interrupter that is small and provides an easily visible open gap.

It is another object of the present invention to provide a rotating arc interrupter having a movable contact blade having a first portion for engaging a stationary main contact and a second portion for engaging an auxiliary contact associated with an arc spinner assembly.

These and other objects of the present invention are efficiently achieved by the provision of a rotating arc fault-current interrupter, also known as an arc spinner interrupter, that establishes an easily visible open gap via a movable blade member having a first portion for engaging a stationary main contact and a second portion formed by an arcing electrode for engaging an auxiliary contact associated with an arc spinner assembly. The geometry, orientation and placement of the auxiliary contact is such that during opening of the movable blade member, the arcing electrode remains engaged with the auxiliary contact after the blade member and the stationary main contact are separated from each other whereby current is transferred through the auxiliary contact into the arc spinner assembly, i.e. the current is commutated into the arc spinner assembly. Thus, the current in the arc spinner creates a magnetic field to cause the arcing current to rotate rapidly so as to extinguish the arc as the arcing electrode separates from the auxiliary contact and moves to the opened position whereby a visible open gap is established that is easily visible without any obstructions from a range of viewing angles or orientations.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
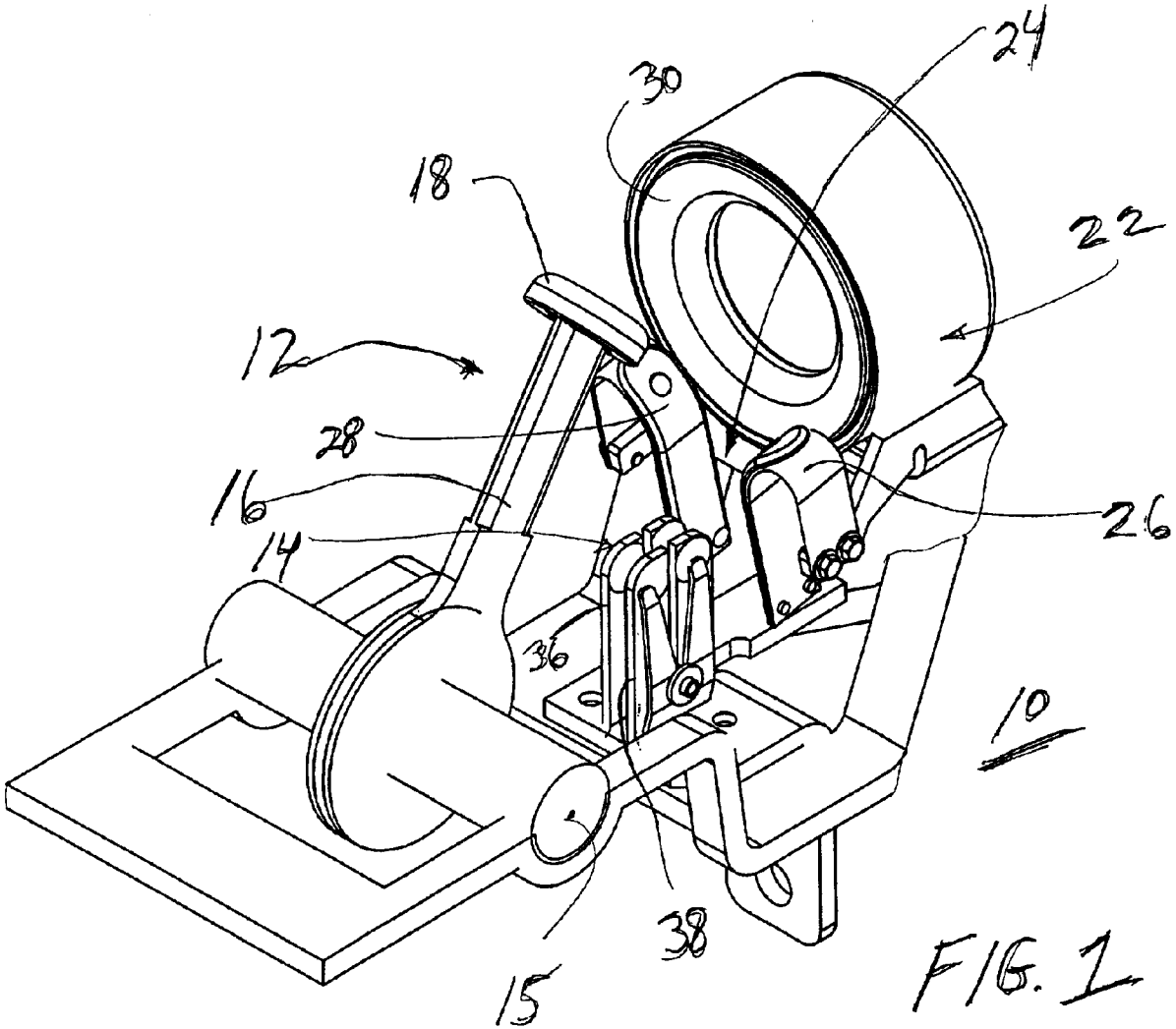
FIG. 1 is a perspective view of a rotating arc fault-current interrupter switch in accordance with the principles and features of the present invention, and shown in the opened position.
Figure 2:
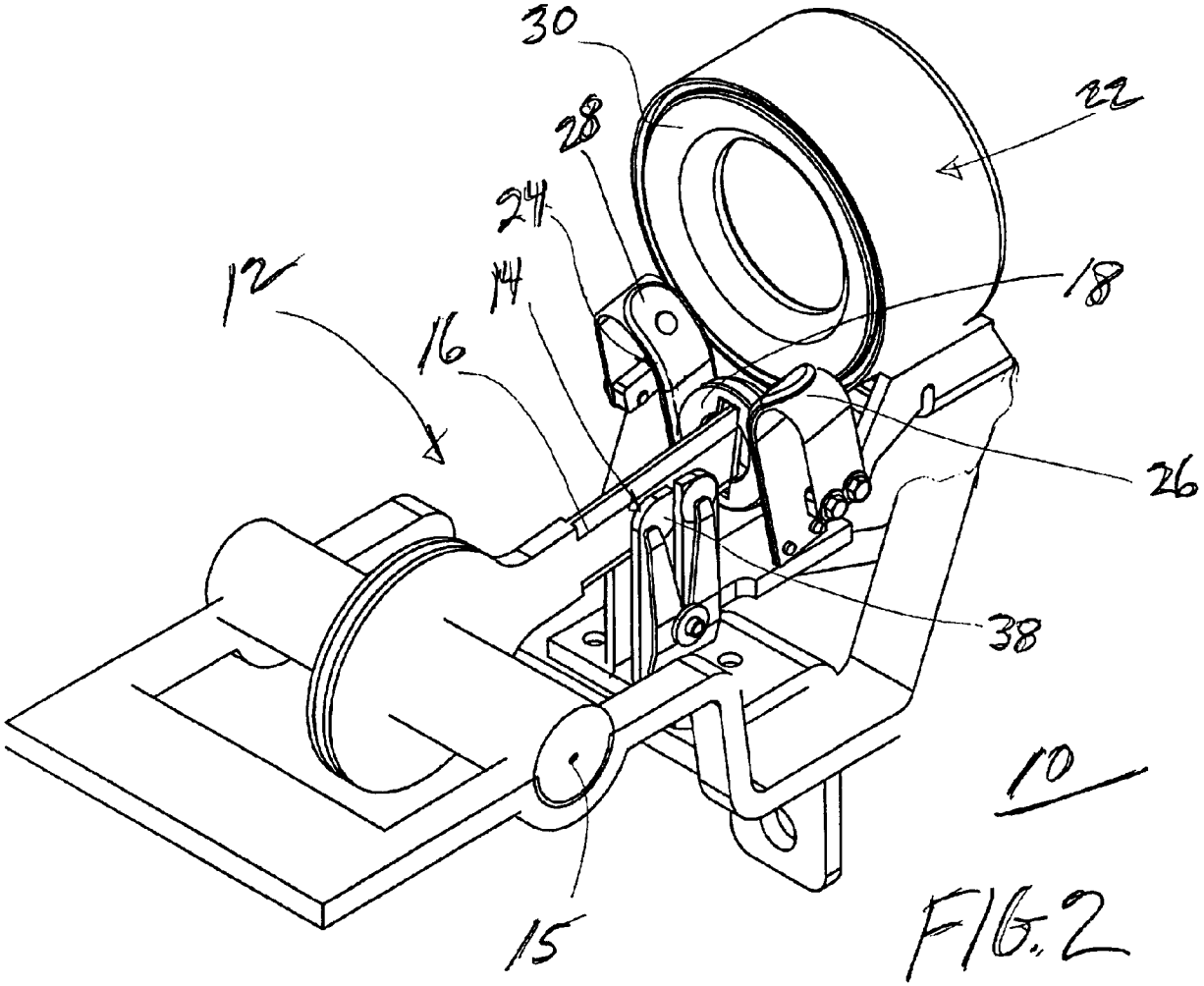
FIG. 2 is a perspective view of the rotating arc interrupter switch of FIG. 1 shown in the closed position.
Figure 3:
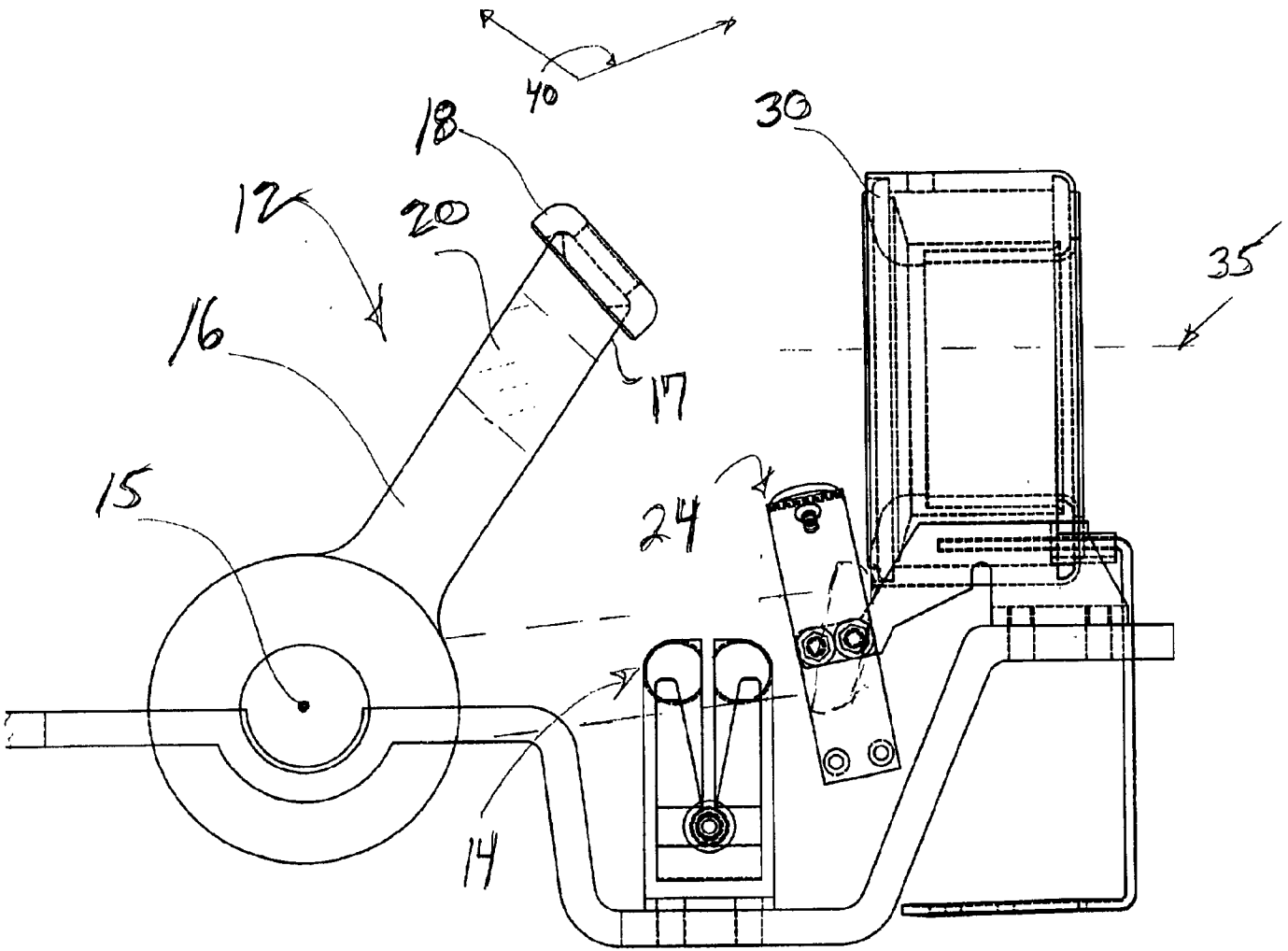
FIG. 3 is a rear elevational view of the rotating arc interrupter of FIG. 1.

Referring now to FIGS. 1–3, a fault-current interrupter switch 10 that is illustrative of the principles of the present invention includes a movable contact assembly 12 and a stationary main contact 14, the movable contact assembly 12 being movable between respective opened (FIG. 1) and closed (FIG. 2) positions with respect to the stationary main contact 14. The closed position is also shown by dashed lines in FIG. 3. In a specific arrangement, the movable contact assembly 12 is pivotally mounted for movement about an axis 15. The movable contact assembly 12 includes a blade member 16 carrying an arcing electrode 18 at the end of the blade member 16. A first predetermined portion 20 (FIG. 3) of the blade member 16 engages the stationary main contact 14 as the movable contact assembly 12 moves to the closed position as shown in FIG. 2. The interrupter switch 10 also includes a generally cylindrical arc spinner assembly 22 and an auxiliary contact 24 that is in engagement with the arcing electrode 18 when the movable contact assembly 12 is in the closed position as shown in FIG. 2. The auxiliary contact 24 may also be characterized as a shunt contact. The auxiliary contact 24 is electrically connected to the arc spinner assembly 22.

The geometry, orientation and placement of the auxiliary contact 24 is such that during opening of the movable contact assembly 12, the arcing electrode 18 remains engaged with the auxiliary contact 24 after the blade member 16 and the stationary main contact 14 are separated from each other whereby current is transferred through the auxiliary contact 24 into the arc spinner assembly 22, i.e. the current is commutated into the arc spinner assembly 22. For example, as shown in FIGS. 1–3, the auxiliary contact 24 extends farther along the path of movement of the blade member 16 than does the stationary main contact 14. Thus, the current in the arc spinner creates a magnetic field to provide an arc spinner so as to extinguish the arc as the arcing electrode 18 separates from the auxiliary contact 24 and moves to the opened position of FIG. 1 whereby a visible open gap is established. For example, as shown in FIG. 3, a clear indication of a visible open gap is provided without any obstructions as illustrated by a range of typical viewing angles or orientations referred to at 40. That is, with this arrangement, blade member 16 with arcing electrode 18 moves away from the arc spinner assembly 22 so as to be clearly separated therefrom.

This fault-current interrupter switch 10 has been found suitable to interrupt fault currents of 12,500 amperes at 15.5 kV. Additionally, a multi-phase arrangement of such fault-current interrupter switches 10 may be provided with an approximate spacing of five inches phase-to-phase, e.g. supported within and separated by insulating sheets, as illustrated in more detail in U.S. Pat. No. 5,864,107. This may be accomplished in an environment of an insulating gas, e.g. in SF-6 gas with pressures as low as 5–10 psig.

In the illustrative geometry of FIGS. 1–3, the stationary main contact 14 and the auxiliary contact 24 are generally aligned with respect to the path of the movement of the blade member 16, the stationary main contact 14 being positioned nearer to the axis 15 of the blade member 16 than the auxiliary contact 24, while the auxiliary contact 24 extends to a position nearer the leading edge 17 of the blade member 16. The blade member 16 defines a plane of movement between the closed and opened position. The pivotal mounting axis 15 is perpendicular to this plane. Additionally, the arc spinner assembly 22 defines a central axis 35 that is in the plane of defined by the movement of the blade member 16. Further, the stationary main contact 16 and the auxiliary contact 24 are also in the plane defined by the movement of the blade member 16.

In the illustrative arrangement of FIGS. 1–3, the auxiliary contact 24 is formed by two arm members 26, 28 that are flexible and spaced apart for suitable contact with the arcing electrode 18. Further, in the illustrative arrangement, the stationary main contact 14 is formed by two resiliently biased jaw contact arms 36, 38 to provide suitable contact pressure when engaged with the first predetermined portion 20 of the blade member 16. The arc spinner assembly 22 includes a conductive arc runner surface or ring 30 and an electrically connected coil assembly 32.

Figure 4:
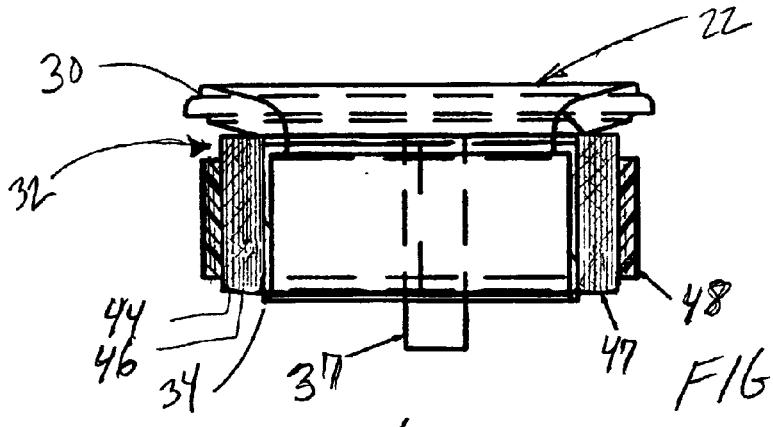
FIG. 4 is a sectional view of the arc spinner assembly of the rotating arc fault-current interrupter of FIGS. 1–3.
Figure 5:
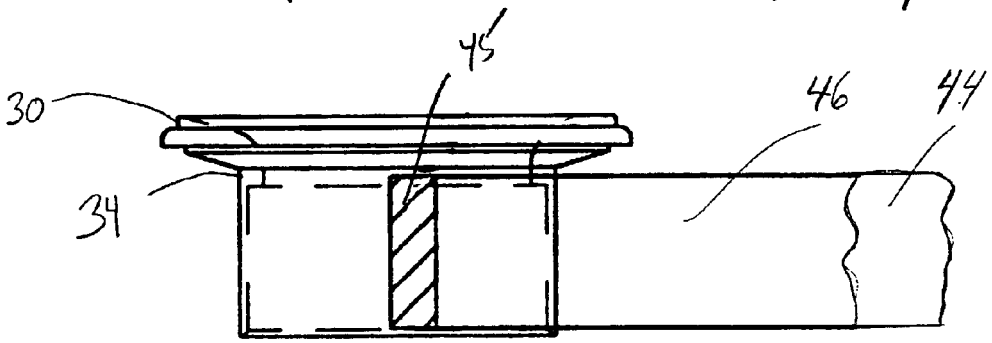
FIGS. 5 and 6 are elevational views of the arc spinner assembly of FIGS. 1–4 illustrating fabrication of a specific embodiment.
Figure 6:
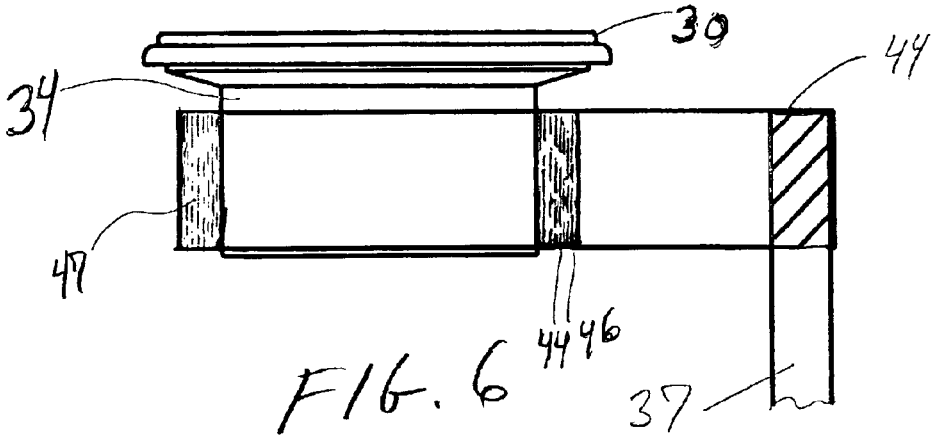

Referring now additionally to FIGS. 4–6 and considering a specific illustrative embodiment of the arc spinner assembly 22, the coil assembly 32 of the arc spinner assembly 22 is formed by electrically attaching a conductive strip 44 at 45 to the elongated cylindrical portion 34 of the arc spinner assembly 22, and then winding the conductive strip 44 along with an insulating strip 46 about the cylindrical portion 34 to form a coil via a plurality of turns or revolutions (e.g. approximately 15 turns) about the portion 34 as shown in FIG. 6 at 47 and providing an electrical coil output lead at 37 for connection to the auxiliary contact 24 and the stationary main contact 14. In a specific embodiment, after the turns of the conductive strip 44 along with the interposed turns of the insulating strip 46 are wound to form the coil 47, tape 48 is wrapped around the coil 47 to retain the coil 47. In a specific implementation, the conductive strip 44 is C-110 having an approximate thickness of 0.016 inches, the insulating strip 46 strip is woven glass material having an approximate thickness of 0.006 inches, and the tape 48 is Permacell glass-filled tape, type P-21.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. An interrupter comprising:

movable contact means movable between open and closed positions;

a stationary contact being engaged by said movable contact means in said closed position;

an auxiliary contact being spaced from said stationary contact and being in engagement with said movable contact means during separation of said movable contact means from said stationary contact; and magnetic field generating means responsive to current through said auxiliary contact for generating a magnetic field to extinguish arcing currents, said movable contact means comprising a blade member having a first portion for engagement with said stationary contact and a second portion for engagement with said auxiliary contact such that said first portion does not engage said auxiliary contact, said auxiliary contact being electrically connected to said magnetic field generating means.

2. The interrupter of claim 1 wherein said auxiliary contact and said stationary main contact are arranged such that upon opening of said blade member, said blade member remains in engagement with said auxiliary contact after said blade member separates from said stationary contact member.

3. The interrupter of claim 1 wherein said auxiliary contact is disposed intermediate said stationary main contact and said magnetic field generating means.

4. The interrupter of claim 1 wherein said blade member is pivotally mounted at a first end thereof, and said first portion of said blade member is intermediate said first end and said second portion of said blade member.

5. The interrupter of claim 4 wherein said second portion is an arcing electrode carried at a second end of said blade member.

6. The interrupter of claim 1 wherein said magnetic field generating means comprises an arc spinner.

7. The interrupter of claim 6 wherein said arc spinner comprises a coil including a plurality of winding turns defined by the interleaving of a conductive strip and an insulating strip.

* * * * *